US008138985B2

(12) United States Patent
Cooper

(10) Patent No.: US 8,138,985 B2
(45) Date of Patent: Mar. 20, 2012

(54) DEVICE AND METHOD FOR MODULAR ANTENNA FORMATION AND CONFIGURATION

(76) Inventor: Henry Cooper, Murrieta, CA (US)

( * ) Notice: Subject to any disclaimer, the term of this patent is extended or adjusted under 35 U.S.C. 154(b) by 235 days.

(21) Appl. No.: 12/419,233

(22) Filed: Apr. 6, 2009

(65) Prior Publication Data

US 2009/0251378 A1 Oct. 8, 2009

Related U.S. Application Data

(60) Provisional application No. 61/075,296, filed on Jun. 24, 2008, provisional application No. 61/118,549, filed on Nov. 28, 2008, provisional application No. 61/042,737, filed on Apr. 5, 2008, provisional application No. 61/042,752, filed on Apr. 6, 2008.

(51) Int. Cl.
*H01Q 13/10* (2006.01)
*H01Q 21/26* (2006.01)

(52) U.S. Cl. ..... 343/770; 343/797

(58) Field of Classification Search ..... 343/770, 343/797

See application file for complete search history.

(56) References Cited

U.S. PATENT DOCUMENTS 5,845,391 A * 12/1998 Bellus et al. ..... 29/600
6,525,696 B2 * 2/2003 Powell et al. ..... 343/770
6,552,691 B2 * 4/2003 Mohuchy et al. ..... 343/770
7,280,082 B2 * 10/2007 Theobold et al. ..... 343/797

* cited by examiner

*Primary Examiner* — Hoang V Nguyen
(74) *Attorney, Agent, or Firm* — Donn K. Harms

(57) ABSTRACT

An antenna and method of forming an antenna from first and second planar substrates having antenna elements engaged thereto adapted to transmit and/or receive a desired RF frequency. Notches in some of the substrates engage traversing substrates to form an array with horizontally and vertically disposed antenna elements all in an electrical communication with electrical pathways on the rear surface of one or both of the first and second planar surfaces.

6 Claims, 5 Drawing Sheets

DEVICE AND METHOD FOR MODULAR ANTENNA FORMATION AND CONFIGURATION

This application is claims priority to U.S. Provisional Application 61/075,296 filed Jun. 24, 2008 and U.S. Provisional Application 61,118,549 filed Nov. 28, 2008, and U.S. Provisional Application 61,042,737 filed Apr. 5, 2008, and U.S. Provisional Application 61,042,752 filed Apr. 6, 2008, all four of which are incorporated herein in their entirety by reference.

BACKGROUND OF THE INVENTION

1. Field of the Invention

The present invention relates to antennas formed of multiple radiator elements. More particularly it relates to a device and method for both forming and configuration array antennas of multiple elements from cooperatively engageable components which allows for the formation of steerable broadcast and reception antennas which can be custom configured for frequency and gain and other factors.

2. Prior Art

Conventionally, antennas are formed in a structure that may be adjustable for frequency and gain by changing the formed structural elements. Shorter elements for higher frequencies, longer elements for lower, and pluralities of similar elements to increase gain. However, the formed antenna structure itself is generally fixed but for elements that may be adjusted for length or angle to better transmit and receive on a frequency.

As such, when constructing a communications array such as a cellular antenna grid, or a wireless communications web, the builder is faced with the dilemma of obtaining antennas that are constructed for the frequencies required for job at hand from suppliers. Most such antennas are custom made to match the frequencies to be employed at the site which can vary widely depending on the network and venue.

Also, a horizontal, vertical, or circular polarization scheme that may be desired to either increase bandwidth or the total number of possible individual connections. Further consideration must be given to the gain at the chosen frequency and thereafter elements included in the final structure to meet the gain requirements and possible beam steering requirements.

However, such antennas once manufactured, offer little means of adjustment of the frequency range, and gain since they are generally fixed in nature. Further, since they are custom manufactured to the frequency, gain, polarization, beam width, and other requirements, lead time can be a problem.

Still further, for a communications system provider working on many different bands, with many frequencies, in differing wireless cellular or grid communications schemes, a great deal of inventory of the various antennas for the plurality of frequencies employed at the desired gains and polarization schemes must be maintained. Without stocking a large inventory of antennas, delays in installation can occur. Such a requirement increases costs tremendously or lead time if the needed antenna configuration is not at hand.

Still further, during installation, it is hard to predict the final antenna construction configuration since in a given topography what works on paper may not work in the field. Additionally, what exact gain and polarization or frequency might be required for a given system as it is being installed might not match predications. The result being that a delay will inherently occur where custom antennas must be manufactured for the user if they are not stocked.

This is especially true in cases where a wireless grid or web is being installed for a wireless communications system. The frequencies can vary widely depending on the type of wireless communications being implemented in the grid, such as cellular or WiFi. The system requirements for gain, and individual employed frequency can also vary depending on the FCC and client's needs.

As such, there is a continuing unmet need for an improved device and method for easy formation, and configuration of a radio antenna. Such a device would best be modular in nature and allow a high degree of custom configuration for frequency, polarization, gain, and direction, steering and other factors.

Such a device should employ a standardized number of base components adapted for engagement to mounting towers and the like and which provide electrical pathways to standardized connection to transceivers from the antenna elements. Such a device should provide for a wide range of different frequency element components to be employed to customize the configured antenna.

Such a device would be best in a kit of element components each of which are easily engageable with the base components. These element components should have electrical pathways which engage those of the base components to allow for a snap-together or frictional engagement to the base components which concurrently achieves an electrical connection from the elements, across the base component, and to the transceiver.

SUMMARY OF THE INVENTION

The device and method herein disclosed and described achieves the above-mentioned goals through the provision of modular components adapted for engagement to form an antenna which is highly customizable for frequency, gain, polarization, steering, and other factors.

The device employs a plurality of base or vertical board members formed of non conductive substrate material each of which are configured with electrical pathways thereon terminating at connector points to communicate between the engageable antenna elements, and wired connectors communicating with a transmitter, receiver, or transceiver. One or a plurality of the vertical board members arranged in parallel, provide registered points of engagement for the frictional connection with horizontal board members formed of substrate material on which antennas or antenna elements are positioned. The vertical board members may also have antenna elements positioned thereon generally on a side surface opposite the electrical pathways or on a layer insulated from the pathways.

In the modular kit of components, the vertical or base board members would be adapted to engage a mount which registers the terminals of the electrical pathways in an electrical engagement to conductors communicating with the transmission and reception equipment. At the other end of the electrical pathways are connection points that engage with antenna elements on the base member or might be placed to register in engagement with pathways leading to the antenna elements, on horizontal board members.

Physical frictional engagement is enabled by slots in the vertical board members sized to engage with notches in the horizontal board members providing the mount for the antennas. Engaging the slots with the notches will automatically align the horizontal board members carrying the antenna elements with connection points on the secondary base members or with the electrical pathways on the vertical board members.

The horizontal board members may have antenna radiator elements formed or engaged thereon which may be adapted to virtually any frequency desired by the user. Thus, a kit of horizontal board members, each with different types of antenna elements thereon, dimensioned for operation at different frequencies, will allow a user to assemble the modular parts into an antenna adapted to the frequency desired. The horizontal or element members engaged to the base members have slots at a projecting rear portion which provide a connection point to an element connection.

The secondary board members having electrical pathways thereon, having mating connection points such that engaging the secondary board will connect all of the horizontal antenna elements to connectors and provide an electrical path to communicate them with electronic or other radio equipment. The secondary boards by changing the paths of the electrical pathways formed thereon, can engage the elements in combination with the transceiver, or, can provide isolation of each element and a connection to its own respective transceiver.

Antenna elements formed on the vertical or base members when engaged to a tower in a generally vertical position will provide for vertical polarization while the antenna elements engaged to the substrate of the horizontal board members will provided for horizontal polarization. Employing both horizontal and vertical elements in the same frequency with appropriate electrical pathways to the transceiver may provide for a circular polarization to be achieved.

Alternatively, broadcast and reception of signals on the same or different frequencies can be achieved by assembling horizontal board members with antenna elements each adapted to one or more frequencies and with the vertical board members having antenna elements dimensioned to operate at one or more other frequencies.

The resulting formed antenna structure or array which resembles a sorting box, is thus highly customizable to the task at hand by simply choosing horizontal and vertical board members having antenna elements thereon adapted to the frequency needed. Because all the parts are adapted to engage and connect the antennas to electrical pathways communicating with the transmission and broadcast equipment, installation to a standardized mount of the vertical board members will allow for easy installation in the field for users.

Gain may be increased or decreased by the parallel or independent connections between adjacent horizontal and vertically disposed antenna elements on the substrates of respective horizontal and vertical board members. Combining two vertically disposed antenna elements on different board members will increase the gain, and adding a third or fourth will increase it more. This can be done easily by conventional (not shown) electronic or manual switches or connectors which engage or separate the pathways leading from the antennas, to the transmission and reception equipment. Junction points of the pathways on the horizontal board members to the pathways on the secondary base members may thus be joined, for increasing gain, or provided as separate pathways to the transceiver with the same or different elements to increase the number of individual channels or frequencies available, or just to reduce gain.

When formed in a series of adjacent rectangular cavities steering of the beam is possible in the same fashion by joining or separating antenna elements to pathways leading to transmission equipment.

Using the modular kit herein, highly customizable antenna arrays of individual antenna elements may be literally manufactured in the field from an inventory of horizontal and vertical board members with differing antenna elements engaged to the non conductive substrate material and which are carried in a vehicle.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of this invention to provide an antenna that may be constructed of modular components, to yield transmission and reception frequencies, which are highly customizable by engaging kits of antenna elements formed on substrates with base vertical components.

It is an additional object of this invention to provide such a modular antenna wherein the gain may be increased or decreased by combining or separating adjacent respective horizontal and vertically disposed antenna elements.

These together with other objects and advantages which become subsequently apparent reside in the details of the construction and operation as more fully hereinafter described and claimed, reference being had to the accompanying drawings forming a part thereof, wherein like numerals refer to like parts throughout.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the pioneering conception upon which this disclosure is based may readily be utilized as a basis for designing of other antenna forming structures, methods and systems for carrying out the several purposes of the present disclosed device. It is important, therefore, that the claims be regarded as including such equivalent construction and methodology insofar as they do not, depart from the spirit and scope of the present invention.

BRIEF DESCRIPTION OF DRAWING FIGURES

DETAILED DESCRIPTION OF THE PREFERRED EMBODIMENTS OF THE INVENTION

Figure 1:
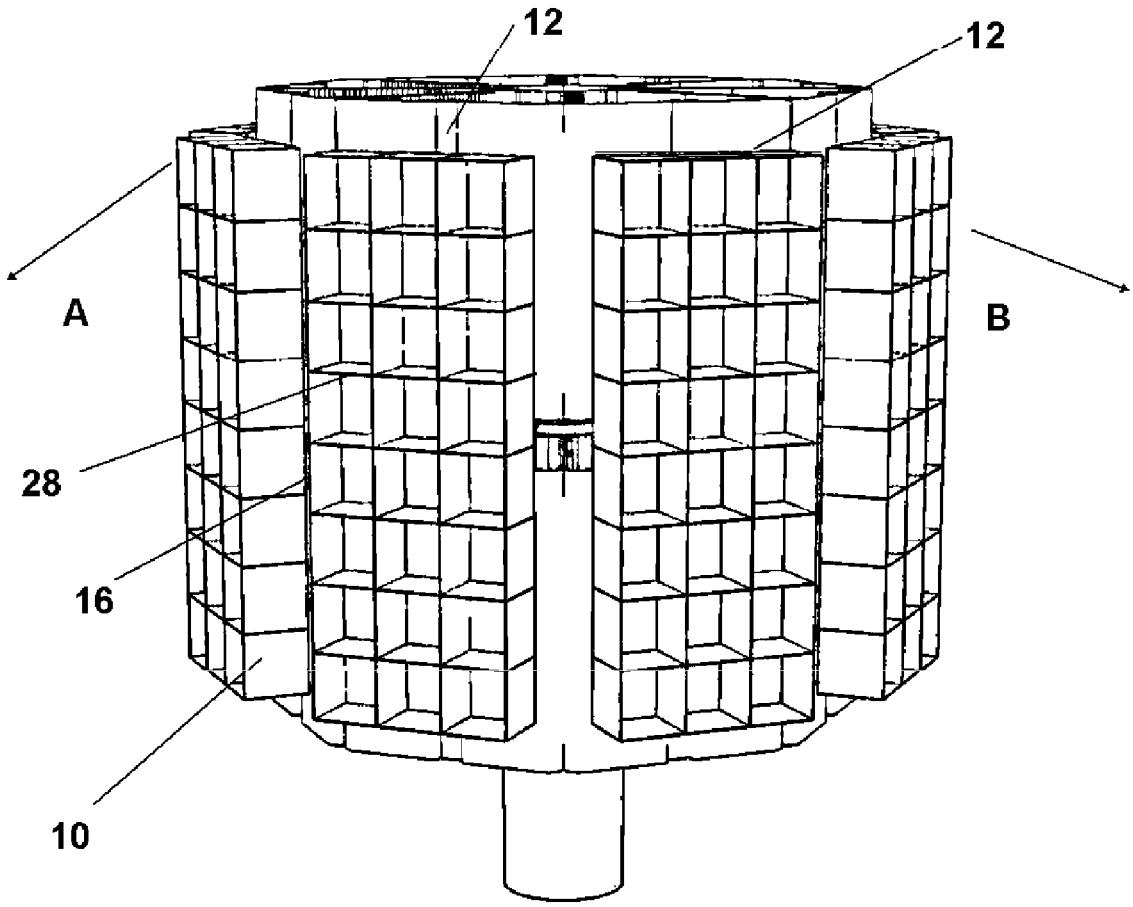
FIG. 1 depicts a tower engaged plurality of the modular formed antennas herein.

Referring now to the drawings of FIGS. 1-9, the modes of the device 10 and method herein disclosed. The device 10 is adapted for engagement to a pole mount 12 on the rear side of the device 10.

As shown in FIGS. 2-7, the device 10 yields an antenna array which is modular and formed of a plurality of planar base members 16 and secondary base members 17, each of which are configured with electrical pathways 18 terminating at connector points 20 to communicate between the engageable antenna elements 22, and a transmitter, receiver, or transceiver or other electronic device operating on the frequency to the antenna element 22 or elements to which it is engaged.

In forming an array, one or a plurality of the base members 16 formed of non conductive substrate and secondary base members 17 also of non conductive substrate, are arranged in parallel and provide slots 24 as a means for frictional connection with the traverse horizontal board members 28 on which antenna elements 22 adapted to the desired frequency or frequencies, are positioned. The base members 16 may also have antenna elements 22 positioned thereon.

The slots 24 in the base members 16 and the secondary base members 17 are sized to engage with notches 34 in the horizontal board members 28. Engaging the slots 24 with the notches 34 will automatically provide a means to align all the horizontal board members 28 carrying the antenna elements 22 with each other horizontally and with the connector points 36 on the secondary base members 17 engaging the antenna elements 22 with the electrical pathways 18 on the secondary base members 17.

The horizontal board members 28 may have antenna elements 22 formed or engaged thereon which are adapted to virtually any frequency desired by the user. The secondary board members having electrical pathways 18 thereon leading to mating electrical connection points 35 adjacent to the termination point of the notches 34 such that engaging the secondary base member 17 can connect all of the horizontal antenna elements 22 to the connectors 20 leading to the radio equipment individually, or combined, depending on the formation of the pathways 18 and number of terminating connectors 20. Thus gain may be increased by pathways combining elements 22 or individual carrier frequencies increased by providing pathways 18 that provide separate communications of individual elements 22 to a transceiver. The combining or separation of the individual antenna elements 22 in either the horizontal or vertical disposition can also be controlled by conventional (not shown) electronic or manual switches or connectors. Electronic switches (not shown) can be computer controlled to allow the array formed to adapt to radio traffic and flow.

A ground plane 40 may also be provided also having slots there through to allow communication of the horizontal board members 18 through the ground plane 40 and a rear connection of the secondary base members 17 to the aligned notches 34.

Figure 2:
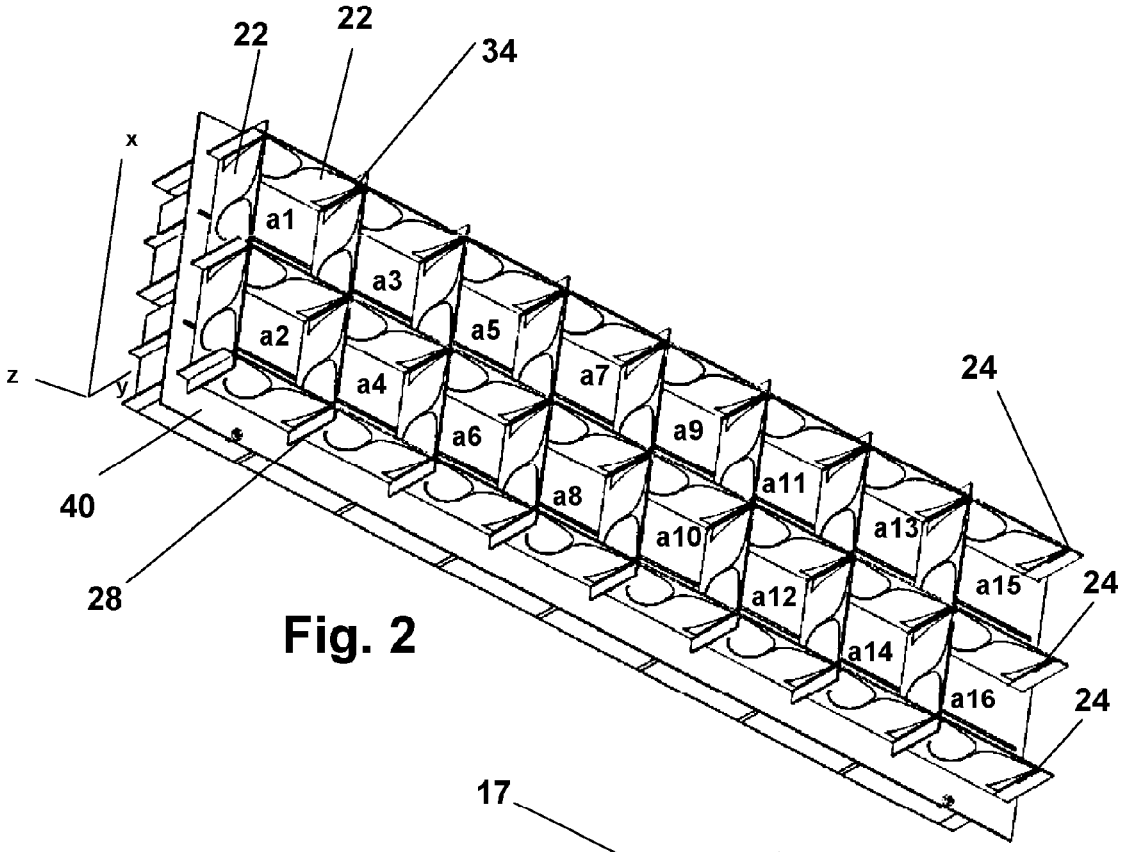
FIG. 2 depicts one of the modular antennas herein showing the rectangular cavities having antenna elements therein.
Figure 3:
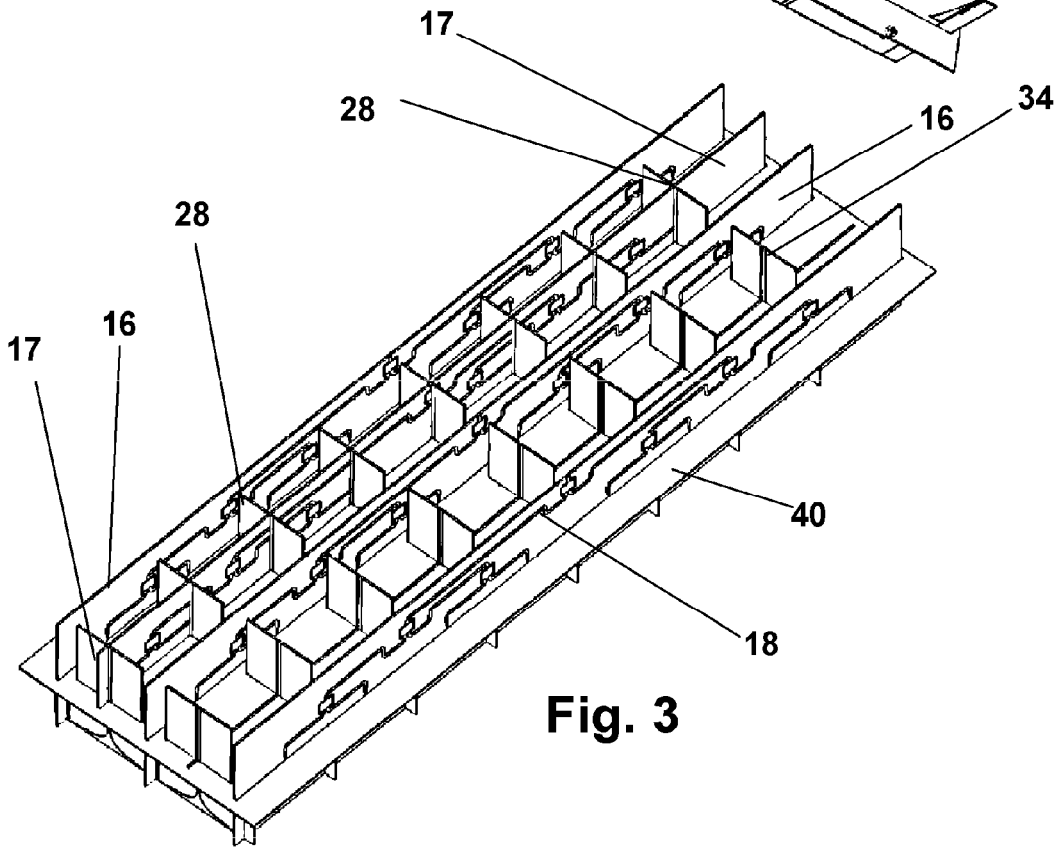
FIG. 3 is a rear perspective view of FIG. 2 showing the pathways on the base members adapted to engage traverse or horizontal members.
Figure 4:
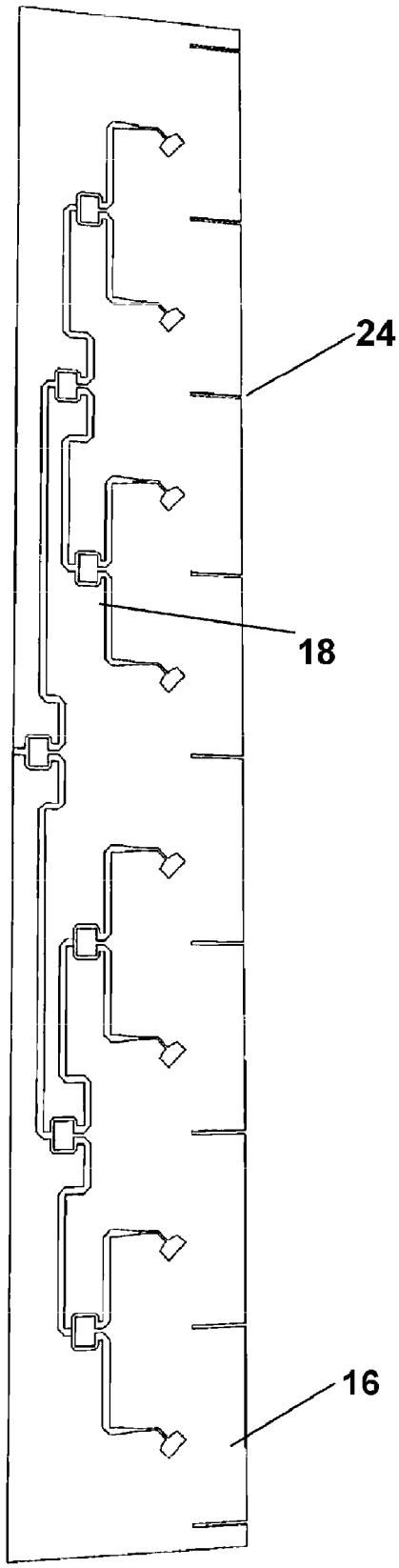
FIG. 4 depicts a base member with slots and a plurality of antennas formed on a first side.
Figure 5:
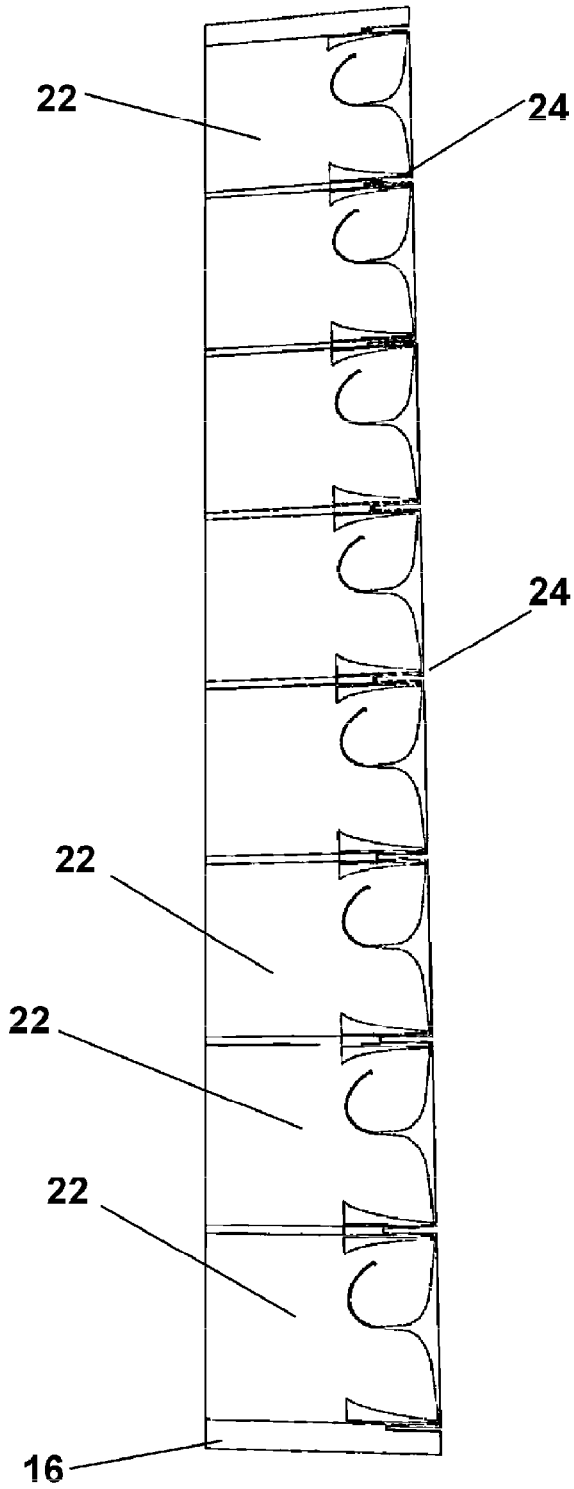
FIG. 5 shows the rear of the device in FIG. 4 and the electrical pathways thereon.

The formed antenna array will resemble a sorting bin and have a plurality of adjacent rectangular cavities such as shown in FIG. 2 (a1-a16) where the employment of pathways 18 on the base members 16 and secondary members 18 to combine adjacent parallel antenna elements 22 such as those in AI-A2, will yield increased gain, and increasing power to the horizontally disposed elements 22 allows for beam steering angle changes A-B shown in FIG. 1 for the transmission and reception beam.

In a method of assembly, the correct antenna element 22 configured for the desired frequency, and engaged to the substrate, would be chosen from the kit of base members 16 and horizontal members 28 for the job at hand. The horizontal and base members would be engaged through the ground plane 40 which essentially operates as a jug, and then the secondary base members 17 engaged to the aligned notches 34. The assembled antenna array is then engaged to the tower where the connectors 20 mated with connections leading to transceivers.

Figure 6:
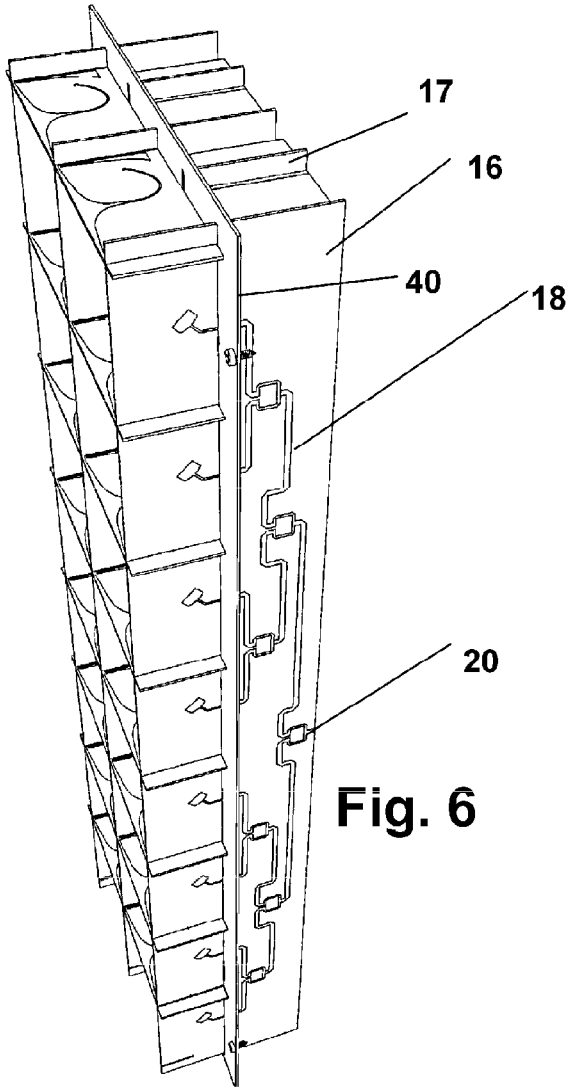
FIG. 6 shows a side view of the device of FIG. 5 and the pathways formed thereon to communicate between antenna elements and transceivers, receivers, or other components.
Figure 7:
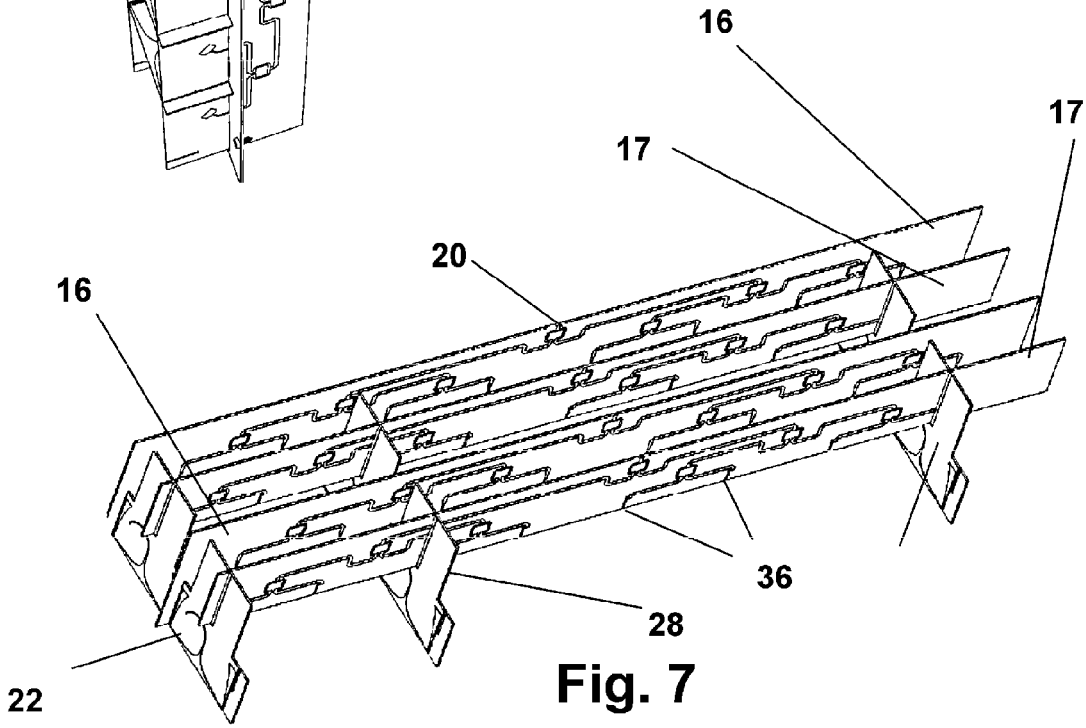
FIG. 7 depicts the device wherein the horizontal members are being engaged with the vertical or base members.
Figure 9:
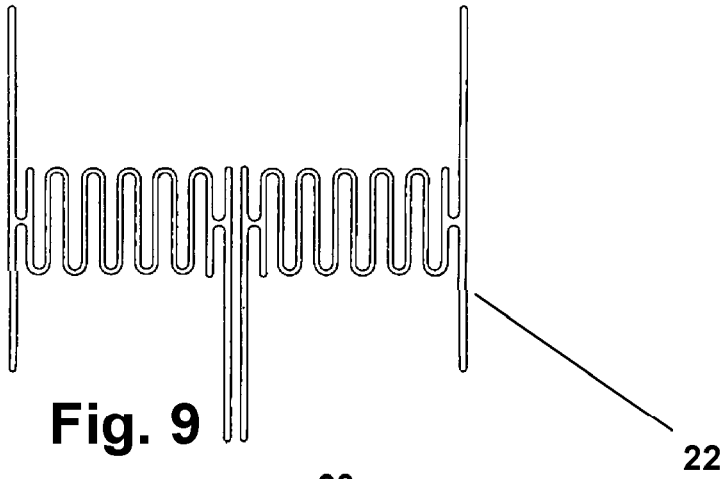
FIG. 9 shows another element dimensioned for different frequencies from that of FIG. 8 and which could be engaged to the horizontal or vertical members.
Figure 8:
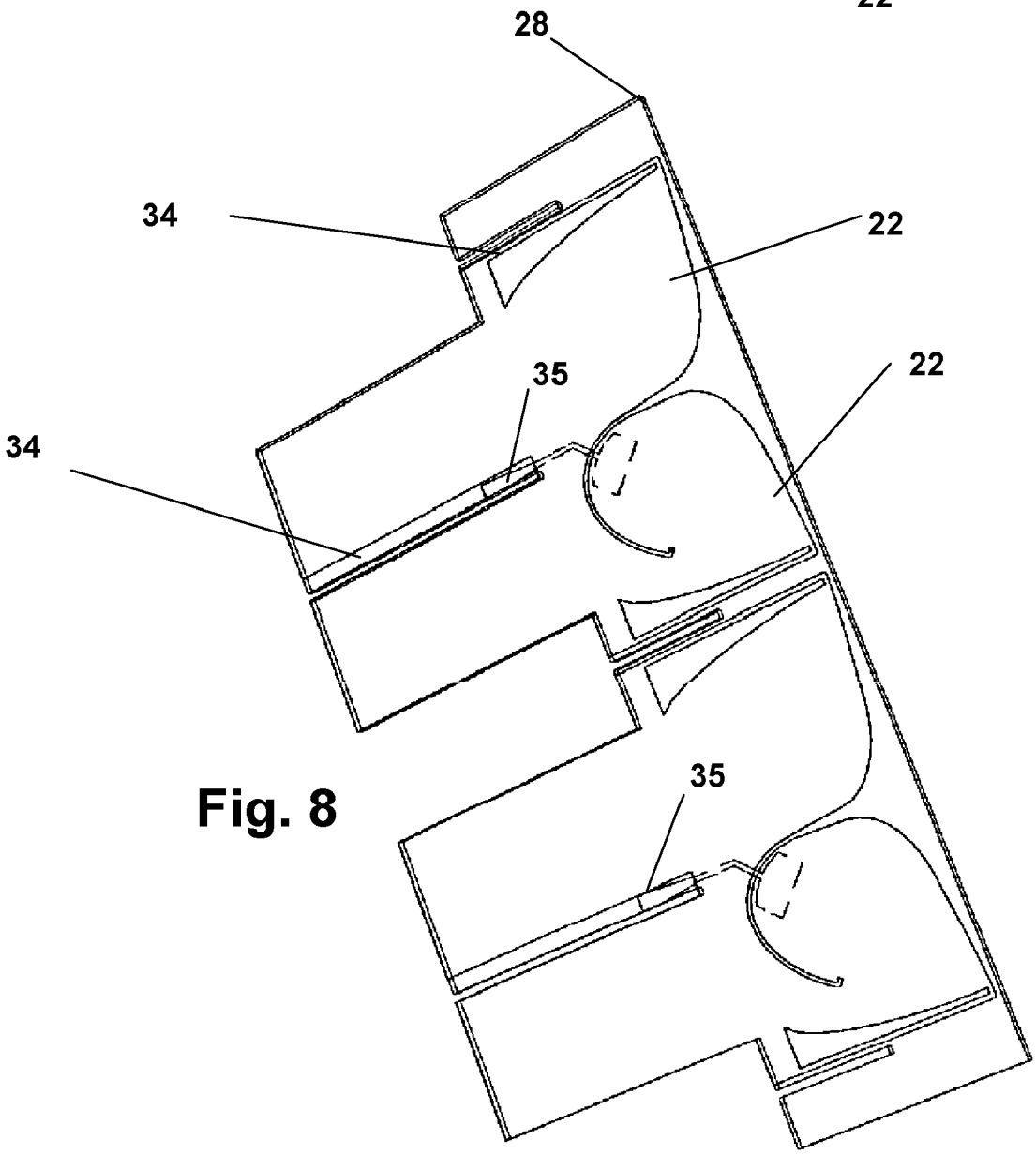
FIG. 8 depicts a horizontal member with adapted to engage slots in the vertical members and a particularly preferred element configuration.

It should be noted that the employment of the term horizontal and vertical referring to antenna element 22 positioning is relative and that the formed array as depicted in FIGS. 1 and 6 might just as easily be installed with a short side being vertical and a longer side being horizontal.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. An antenna comprising:

at least one first planar substrate having a first surface thereon;

at least one antenna element engaged to said first surface;

a notch in said first planar substrate having an open end and a terminating end;

connectors located adjacent to said terminating end, said connectors in electrical communication with said antenna element;

a secondary planar member having a first surface and having a second surface with an electrical pathway thereon, said pathway terminating at connector points on one end and adapted for engagement with a transceiver on a second end;

said secondary planar member having an engageable position in said notch, said connecter points in an electrical communication with said connectors when said secondary planar member is in said engaged position;

a plurality of said first planar substrates each having a first surface thereon;

said plurality of said first planar substrates positioned substantially parallel to each other;

a plurality of said antenna elements engaged to said first surface of each said first planar substrate;

a plurality of notches in each said first planar substrates having an open end and a terminating end;

connectors located adjacent to each said terminating end, said connectors in electrical communication with a said antenna element proximate thereto;

a plurality of said secondary planar members each having a first surface and having a second surface with an electrical pathway thereon, each said pathway terminating at connector points on one end and adapted for engagement with a transceiver on a second end;

each of said secondary planar member having an engageable position in a said notch on each of said plurality of said first planar substrates thereby holding all of said plurality of said first planar substrates parallel and at a fixed distance to each other;

individual said connecter points in an electrical communication with respective individual said antenna elements when said secondary planar member is in said engaged position;

means for electronic switching to combine or separate electrical communication between said antenna elements to thereby provide means to control gain; and whereby an antenna array is formed by engagement of a secondary planar member with a said notch in each of said first planar members with each said antenna element thereby in electrical communication with a respective said second end of said electrical pathway which is adapted for engagement to a transceiver or electronic receiver.

2. The antenna of claim 1 additionally composing:

a plurality of secondary said antenna elements also positioned on said first surface of said secondary planar members;

said secondary said antenna elements in communication with a said electrical pathway;

said antenna elements positioned on said first planar substrate having a one of a horizontal or vertical polarization; and said secondary antenna elements having the other of said horizontal or vertical polarizations from those on said first planar substrate.

3. The antenna of claim 2 additionally composing:

means for electronic switching to combine or separate electrical communication between said antenna elements positioned on said first planar substrates, to thereby provide means to control gain thereof.

4. The antenna of claim 1 additionally composing:

means for electronic switching to combine or separate electrical communication between said antenna elements positioned on said first planar substrates, to thereby provide means to control gain thereof, means for electronic switching to combine or separate electrical communication between said secondary antenna elements positioned on said secondary planar substrates, to thereby provide means to control gain thereof.

5. A method for formation of an antenna array of claim 1 comprising the steps of:

choosing a plurality of said first planar substrates each having a first surface thereon with a plurality of said antenna elements adapted to a frequency chosen therefor, engaged to said first surface of each said first planar substrate;

choosing a plurality of said secondary planar members;

engaging said secondary planar members within a plurality of notches in each said first planar substrates to thereby engage said connectors located adjacent to each said terminating end, said connectors in electrical communication with a said antenna element upon said first planar substrate;

whereby said antenna array is formed by engagement of a secondary planar member with a said notch in each of said first planar members and each said antenna element is thereby in an electrical communication with a respective said second end of a said electrical pathway.

6. The method of claim 5 additionally comprising:

choosing said plurality of said first planar substrates each having a first surface thereon with a plurality of said antenna elements adapted to a frequency chosen therefor, from a kit of different said first planar substrates having antenna elements attached thereto configured for optimum performance in different frequencies.

* * * * *